US005726006A

United States Patent [19]

Gourlaouen et al.

[11] Patent Number: 5,726,006

[45] Date of Patent: Mar. 10, 1998

[54] TABULAR GRAIN SILVER HALIDE EMULSIONS, A METHOD FOR THEIR PREPARATION AND PHOTOGRAPHIC PRODUCTS

[75] Inventors: Luc Renaud Gourlaouen, Givry; Gérard Amédé Désiré Friour, Chalon-Sur-Saone; Pierre-Henri Jezequel, Givry; Frédéric Xavier Jordi, Saint Vincent En Bresse; Jean-Pascal Francis Lebrat, Chalon-Sur-Saone, all of France

[73] Assignee: Eastman Kodak Company, Rochester, N.Y.

[21] Appl. No.: 676,550

[22] Filed: Jul. 9, 1996

[30] Foreign Application Priority Data

Jul. 10, 1995 [FR] France ..... 95 08681

[51] Int. Cl.[6] ..... G03C 1/005; G03C 1/035

[52] U.S. Cl. ..... 430/567; 430/569; 430/603; 430/605

[58] Field of Search ..... 430/567, 569, 430/603, 605

[56] References Cited

U.S. PATENT DOCUMENTS

| | | | |
|---|---|---|---|
| 4,063,951 | 12/1977 | Bogg | 430/567 |
| 4,386,156 | 5/1983 | Mignot | 430/567 |
| 5,565,314 | 10/1996 | Nakatsu et al. | 430/567 |

FOREIGN PATENT DOCUMENTS

| | | | |
|---|---|---|---|
| 0 569 971 | 11/1993 | European Pat. Off. | G03C 1/005 |
| 0 584 644 | 3/1994 | European Pat. Off. | G03C 1/005 |
| 93-281640 | 10/1993 | Japan | G03C 1/035 |

*Primary Examiner*—Mark F. Huff
*Attorney, Agent, or Firm*—Carl O. Thomas

[57] ABSTRACT

A photosensitive emulsion is disclosed comprised of a dispersing medium and silver halide grains containing at least 80 mole percent bromide, based on silver, wherein at least 50% of the projected area of said silver halide grains is accounted for by tabular grains free of twin planes having {100} parallel major faces, said emulsion being chemically sensitized and having a reciprocity failure of less than 35 sensitivity units between exposures of respectively $10^{-5}$ seconds and 100 seconds. The emulsion can be employed as a latent image forming emulsion in a photographic element.

The emulsion can be prepared by a process preparing a silver bromide photosensitive emulsion, comprising the following essential steps: (a) a nucleation step whereby a fine-grain emulsion with a pAg of between 4 and 6.5 and a pH of between 2 and 5 is precipitated, while maintaining, at the start of the nucleation and for a short time, a stoichiometric excess concentration of silver corresponding to a pAg of less than 5, and (b) a physical ripening step, at a pAg of between 8 and 9.5 and a pH of between 6 and 8.

7 Claims, No Drawings

TABULAR GRAIN SILVER HALIDE EMULSIONS, A METHOD FOR THEIR PREPARATION AND PHOTOGRAPHIC PRODUCTS

FIELD OF THE INVENTION

The present invention relates to photosensitive silver halide emulsions useful in photography and to a method for their preparation.

DEFINITION OF TERMS

An emulsion is said to be a tabular grain emulsion when at least 50% of the total projected area of the silver halide grains is accounted for by tabular grains. A grain is considered to be tabular when the ratio of its equivalent circular diameter (ECD) to its thickness is at least 2. This ratio is known as the "aspect ratio". The equivalent circular diameter is the diameter of a circle having an area equal to the projected area of the grain. The term "intermediate aspect ratio" designates an aspect ratio in the range of from 5 to 8. The term "high aspect ratio" designates an aspect ratio of greater than 8. The term "thin tabular grains" designates tabular grains whose thickness is less than 0.2 μm. Typically tabular grains have a thickness of less than 0.3 μm.

In the present description and in the accompanying claims, the term "high bromide" in refering to grains and emulsions means that the bromide represents, in moles, based on silver, at least 80% of the total halides and preferably 90%, the remainder consisting of chloride and/or iodide.

The term "major faces" designates, in the case of tabular grains, the longest parallel faces as opposed to those delimiting the grain in the dimension of its thickness.

BACKGROUND

At the beginning of the 1980s, progress was made in the field of photographic silver halides resulting from the use of silver halide grains in tabular form. The use of tabular grains enables photographic advantages to be achieved for diverse properties, such as the speed/granularity relationship, image sharpness, covering power, developability, stability, and the separation of native and spectral sensitivities.

Most tabular grain emulsions comprise irregular octahedral grains whose major faces lie in {111} crystal planes. These grains contain two or more twin planes that are parallel to each other and to the major faces. The incorporated {111} faces and twin planes pose various problems which consequently place limitations on the extent to which the advantages offered by tabular silver halide grains in photography can be exploited.

it is known that tabular grains containing parallel twin planes can most easily be formed with silver bromide emulsions. However, the twinning of the grains with {100} crystal faces does not produce tabular grains. It is also known that silver bromide has less of a tendency than silver chloride to form grains with {100} faces. Consequently there are few references in the art to emulsions containing high bromide tabular grains with {100} major faces.

Bogg U.S. Pat. No. 4,063,951 describes silver bromide emulsions prepared in an ammoniacal environment and containing {100} tabular grains. These tabular grains have an aspect ratio equal to or less than 4.

Mignot U.S. Pat. No. 4,386,156 represents an improvement with respect to the previous reference, in that no ammoniacal ripening is used. Mignot describes monodisperse tabular grains of silver bromide with {100} major faces whose aspect ratio is higher than 8.5. This method requires the use of dilute solutions in the absence of a ripening agent of the thiocyanate type.

Japanese patent application 93-281640, published on 29 Oct. 1993, describes the obtaining of silver halide emulsions with tabular grains with {100} major faces, and with a core-shell structure—i.e., grains having a core and a shell of a different halide composition.

European patent application 0 569 971, published on 18 Nov. 1993, describes a photographic emulsion with tabular silver halide grains with {100} major faces which have truncations.

European patent application 0 584 644, published on 2 Mar. 1994, describes a photographic emulsion containing tabular grains with {100} major faces, which are stated, by hypothesis and without supporting evidence, to have screw dislocations; these grains also have an intermediate or lower aspect ratio to improve resistance to the fogging caused by pressure stresses.

SUMMARY OF THE INVENTION

In one aspect this invention is directed to a photosensitive emulsion comprised of a dispersing medium and silver halide grains containing at least 80 mole percent bromide, based on silver, wherein at least 50% of the projected area of said silver halide grains is accounted for by tabular grains free of twin planes having {100} parallel major faces, said emulsion being chemically sensitized and having a reciprocity failure of less than 35 sensitivity units between exposures of respectively $10^{-5}$ seconds and 100 seconds.

In another aspect this invention is directed to a photographic element comprised of a support and, coated on the support, at least one layer containing an emulsion of the preceding paragraph.

In an additional aspect this invention is directed to a method for preparing a silver bromide photosensitive emulsion, comprised of the following steps: (a) a nucleation step whereby a fine-grain emulsion with a pAg of between 4 and 6.5 and a pH of between 2 and 5 is precipitated, while maintaining, at the start of the nucleation and for a short time, a stoichiometric excess concentration of silver corresponding to a pAg of less than 5 and (b) a physical ripening step, at a pAg of between 8 and 9.5 and a pH of between 6 and 8.

DESCRIPTION OF PREFERRED EMBODIMENTS

The present invention provides high (>80 mole percent, based on silver) bromide tabular grain emulsions that that exhibit improved reciprocity characteristics. The invention also provides an improved process for their preparation.

The photosensitive emulsions of the invention contain high bromide tabular grains having {100} major faces that account for at least 50 percent of total grain projected area. The tabular grains having {100} major faces contain no twin planes and exhibit an average aspect ratio of greater than 8:1. According to an embodiment, all faces of the grains are (100) faces. Surprisingly, these emulsions have a reciprocity failure of less than 35 units in the range of exposure between $10^{-5}$ sec and 100 sec to light of 3000° K when chemically sensitized, preferably by at least one chemical sensitizer chosen from the class consisting of gold, sulfur and selenium sensitizers.

A photographic exposure is represented by the product E=i×t, where I is the intensity of the exposure and t the duration of the exposure. The reciprocity failure designates the variation noted in the response to two identical photographic exposures, but with different intensities and exposure times. In practice, the variations are compared respectively for exposures equal to a period of $10^{-5}$ seconds and 100 seconds.

According to a preferred embodiment, the emulsion contains at least 70% and more advantageously at least 80% high bromide tabular grains with {100} major faces. Preferably, the average aspect ratio of this population of tabular grains at least 8, most preferably greater than 8. Average aspect ratios of the high bromide {100} tabular grains typically range up to about 25, although still higher average aspect ratios are possible. In one form the high bromide {100} tabular grains can consist essentially of silver bromide. It is contemplated that, in addition, to bromide, as already indicated, a minor proportion of iodide and/or chloride can be present. For example, in one preferred form iodide concentrations range from 1 to 10 mole percent, based on total silver, and, most preferably, from 1 to 3 mole % , based on silver.

According to one embodiment, the grains of the emulsion according to the invention are monodisperse—i.e., they have a coefficient of variation of less than 30 percent and preferably less than 10 percent.

The emulsions according to the invention are prepared by precipitating halide and silver salts in the presence of an aqueous hydrophilic colloid. The first step of the method is a nucleation step which involves, first of all, preparing a monodisperse emulsion with fine grains (ECD less than 0.1 and preferably less than 0.08 μm). The coefficient of variation of this population of nuclei is preferably less than 50% and advantageously less than 30%. This fine-grain emulsion acts as nuclei for the following step, which is a physical ripening to increase the size of the grains.

The characteristics of this nucleation step of the method according to the invention are as follows:

The nuclei are formed by simultaneous or alternate double jets, or by a single silver nitrate or halide jet.

Before introducing the jets into the precipitation reactor, the latter can be provided with a certain amount of the dispersion medium (aqueous gelatin solution or an equivalent hydrophilic colloid) to which a little halide is added, for example a little iodide or bromide and certain agents such as acids, buffer agents, etc. Various types of gelatin can be used e.g. bone gelatin, pigskin gelatin, deionized gelatin. It is however recommended not to use oxidized gelatins, i.e. gelatins which have been treated with an oxidizing agent to lower the methionine content to less than 30 micromoles per gram, as disclosed in Maskasky U.S. Pat. No. 4,713,323. The pAg of the reactor is adjusted to a value of 4 to 6.5 and preferably 4.5 to 5.5 and the pH to a value of 2 to 5 and preferably 2.5 to 4. The pAg is adjusted preferably by means of an alkali metal bromide solution and the pH with a dilute aqueous acid not affecting the pAg, such as $HNO_3$. After the nucleation has begun, very fine grain emulsions, such as Lippmann emulsions, can be added to the reactor. For the precipitation of the nuclei, jets are used with a concentration of between 1 and 5M, and advantageously between 3.5 and 4.5M, with flow rates of approximately 50 to 1000 ml/minute. During this nuclei formation step, a stoichiometric excess concentration of silver, which is at least momentary, is produced at the start of nucleation, i.e. over a short time, for example between approximately 0.5 and 200 seconds and advantageously between 10 and 100 seconds. During this period, a pAg of less than approximately 5 is maintained.

The temperature is between 30° and 75° C. During the whole period of the nucleation, the content of the reactor is stirred, in the case of a rotary agitator, at a speed of 500 to 5,000 revolutions per minute. The halide composition of the precipitation jets is such that germs comprising at least 80% molar and preferably 90% molar bromide with respect to the quantity of silver are obtained. The rest of the halide composition can consist of chloride or iodide. When there is another halide, it can be present in the reactor before the precipitation or introduced in the halide jet, or by means of a separate jet. During the nucleation, ripening agents can be added, such as thioethers, fine-grain emulsions or various additives such as doping agents, growth modifiers, etc.

As indicated above, the germs, or nuclei, are used in the following step, which is a ripening step. For the ripening step, temperature and agitation conditions close to those of the preceding nucleation step are used, but the pAg is adjusted to a higher value, between 8 and 9.5, and the pH to a value of between 6 and 8.

Then a conventional growth step can be carried out by adding jets, at a constant or accelerated flow rate, of silver nitrate and alkali metal halide or again a fine-grain emulsion of the Lippmann type, or the different known additives such as growth modifying agents (in so far as these modifying agents do not encourage the formation of twin planes and faces (111) antifogging agents, etc. During this growth step, iodide or chloride in the form of an alkali metal halide solution can be introduced. During the growth step, the choice and the concentration of the peptizing agent can be adjusted in any appropriate manner. It is known that the concentration of peptizing agent can be increased during the growth of the tabular grains. Generally, normal photographic gelatin, such as pigskin gelatin or bone gelatin, is used as a peptizer.

Once formed, the emulsions according to the invention can be finished, with a view to their photographic use, by conventional techniques. These techniques are described in Research Disclosure, September 1994, No 501, publication 36544; see especially Chapter III, Emulsion Washing; Chapter N, Chemical Sensitization; Chapter V, Spectral Sensitization and Desensitization; Chapter VII, Antifogging Agents and Stabilizers; Chapter VIII, Absorbing and Scattering Materials; Chapter IX, Coating Physical Properties Modifying Addenda.

The emulsions according to the invention can be used in any silver halide photographic product, intended for silver halide photography, color photography, medical radiography, radiography with intensifier screens, industrial radiography, etc.

EXAMPLES

PREPARATION OF THE EMULSIONS

The emulsions of the examples which follow are obtained by means of the conventional double-jet precipitation technique.

Emulsion 1a

A reactor contains 15 L of an aqueous solution with 34.7 g/liter of conventional photographic grade gelatin. The temperature was adjusted to 70° C., the pAg to 6.16 and the pH to 3.00 with respectively dilute aqueous solutions of KBr and $HNO_3$. A 4.05 moles/L aqueous solution of silver nitrate and a 4.00 moles/L aqueous solution of potassium bromide were introduced simultaneously into the reactor while stirring at 1,000 revolutions per min (rpm). The nitrate and bromide jets were introduced at the surface of the contents of the reactor. The addition rates were kept constant at 250 mL/min. The addition lasts for 60 sec. Throughout the precipitation, the temperature was maintained at 70° C.

A total of 1 mole of fine-grain emulsion was precipitated, to be used as nuclei in the following ripening step.

Then the physical ripening of the nuclei was carried out by stirring (2,000 rpm) and by adjusting the pAg to 6.16 and the pH to 6.5 with respectively dilute aqueous solutions of KBr and NaOH. The temperature was kept constant at 70° C. for 210 minutes. Emulsion 1 has thus been obtained, which was a silver bromide emulsion comprising 77% tabular grains with {100} major faces having an average ECD of 1.366 μm and a mean thickness of 0.104 μm, which corresponds to an average aspect ratio of more than 10:1. The coefficient of variation (COV) was 1.27 percent.

A sample (0.08 mole) of Emulsion 1 was taken, and the pH was adjusted to 5.6 and the pAg to 8.23. 75 mg of NaSCN per mole of silver and then, per mole of silver, 3.71 mg of $Na_2S_2O_3$ and 2.82 mg of $KAuCl_4$ were added and the mixture was heated at 60° C. for 20 min. Afterwards 360 mg of dye 1 per mole of silver and then 2 g of 4-hydroxy-6-methyl-1,3,3a,7-tetraazaindene (sodium salt) per mole of silver were added. Emulsion 1a is obtained.

Emulsion 1b

Another sample (0.08 moles) of Emulsion 1 was taken, its pH being adjusted to 5.6 and its pAg to 8.23. 75 mg of NaSCN per mole of silver and then 3.53 mg of $Na_3(S_2O_3)_2Au,2H_2O$ were added, and finally, per mole of silver, 259 mg of dye 1 and 91 mg of dye 2 were added. This was followed by heating at 60° C. for 15 minutes, and then 2 g of 4-hydroxy-6-methyl-1,3,3a,7-tetraazaindene (sodium salt) per mole of Ag were added. Emulsion 1b is obtained.

Emulsion 2a

A reactor was provided containing 6.0 liters of an aqueous solution of oxidized gelatin, that is gelatin treated with an oxidizing agent to lower its methionine content to less than 30 micromoles per grams, at 1.25 g per liter. The pH is adjusted to 1.85, the temperature to 45° C. and the pAg to 9.14. While stirring (1,440 rpm), an aqueous solution with 0.5 mole/L of silver nitrate with an antifogging agent added and an aqueous solution with 0.532 mole/l of sodium bromide were introduced concurrently. The addition, at a constant flow rate, lasted 60 sec. The temperature was maintained at 45° C. Fine-grain emulsion (nuclei) in the amount of 0.04 mole were precipitated.

The temperature was raised to 60° C. Then the emulsion was ripened at pH 9.75 by adding 0.115 moles of ammonium sulphate, this being maintained at 60° C. for 9 minutes. One hundred g of gelatin was added, the pH was adjusted to 6.5, and the pAg was adjusted to 9.10. While maintaining the temperature at 60° C., an aqueous solution of silver nitrate at 2.6 moles/L and an aqueous solution of sodium bromide at 2.679 moles/L were added. The addition, at a constant flow rate, lasted 105 min. Emulsion 2 in the amount of 11.31 moles was precipitated, which was a tabular grain emulsion with {111} major faces having an average ECD of 1.88 μm, a mean thickness of 0.122 μm, and a coefficient of variation (COV) of 1.14 percent.

A sample (0.08 mole) of Emulsion 2 was taken, its pH was adjusted to 5.6, and its pAg was adjusted to 8.23. One hundred fifty mg of NaSCN per mole of silver was added, then 5.72 mg of $Na_2S_2O_3$ per mole of silver and 4.37 mg of $KAuCl_4$ per mole of silver. The temperature was maintained at 70° C. for 20 min. Then 367 mg of dye 1 per mole of silver and then 2 g of 4-hydroxy-6-methyl-1,3,3a,7-tetraazaindene (sodium salt) per mole of silver were added. Emulsion 2a was obtained.

Emulsion 2b

A sample (0.08 mole) of Emulsion 2 was taken, its pH was adjusted to 5.6, and its pAg adjusted to 8.23. Per mole of silver, 150 mg of NaSCN were added, then 5.93 mg of $Na_3(S_2O_3)_2Au,_2H_2O$. Per mole of silver, 265 mg of dye 1 and 95 mg of dye 2 were added, and the mixture was heated to 70° C. for 20 minutes. Two g of 4-hydroxy-6-methyl-1,3,3a,7-tetraazaindene (sodium salt) per mole of silver were added. Emulsion 2b was obtained.

Example

Each emulsion sample was applied in a layer to a cellulose triacetate film support at 8.07 mg of silver and 32.3 mg of gelatin per $dm^2$. Incorporated into each layer of emulsion were 10.5 mg/$dm^2$ of coupler 3, which forms the cyan dye. On each layer of emulsion a top layer containing, per $dm^2$, 21.43 mg of gelatin and 1.75% by weight, based on the total weight of gelatin in the sample, of hardener bis (vinylsulfonyl)-methane (BVSM) was applied.

Different portions of each coating were exposed for one of the following periods: $10^{-5}$ sec, $10^{-4}$ sec, $10^{-3}$ sec, $10^{-2}$ sec, $10^{-1}$ sec, 1 sec, 10 sec, 100 sec, so as to evaluate the reciprocity failure.

The sensitivity of the samples is measured for an exposure of $10^{-2}$ sec. For each exposure a 3,000° K light was used with Daylight 5A and Wratten™ 9 filters and a density scale comprising 21 ranges from 0 to 4.0 with an increment of 0.2. Each sample was then developed for 3 min 15 sec by the Kodak Flexicolor™ C-41 process.

The following results are obtained:

TABLE I

| Sample | Relative sensitivity (1) at 1/100 sec | Δ Sensitivity (2) |
|---|---|---|
| 1a (invention) | 119 | 16.9 |
| 1b (invention) | 119 | 17.6 |
| 2a (control) | 100 | 77.3 |
| 2b (control) | 128 | 91.3 |

(1) a difference in sensitivity of 30 units would correspond to a doubling of the sensitivity of the film.
(2) a difference in sensitivity between the $10^{-5}$ second exposure and the 100 second exposure, measured with an X-RITE ™ Model 310 densitometer.
The results in the above table show the effect on the reciprocity failures.

Sensitizing dye 1

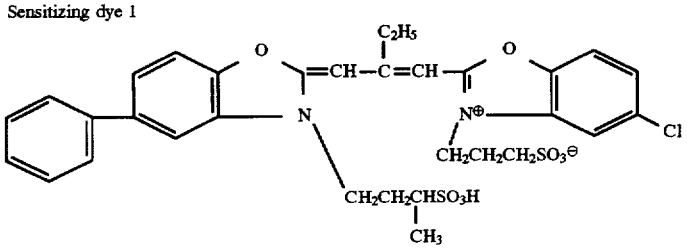

Sensitizing dye 2

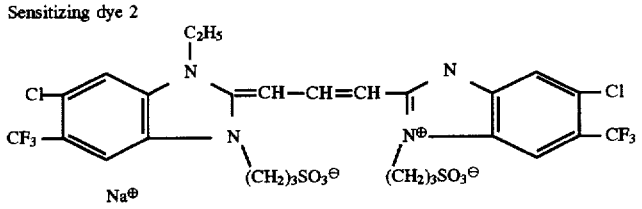

Cyan-forming coupler

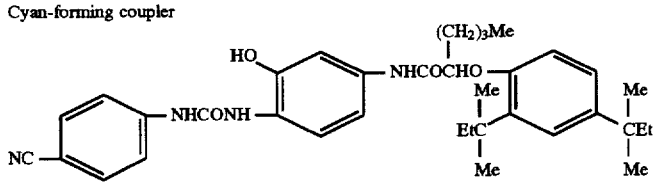

The invention has been described in detail with particular reference to preferred embodiments thereof, but it will be understood that variations and modifications can be effected within the spirit and scope of the invention.

What is claimed is:

1. A method for preparing a photosensitive emulsion comprised of a dispersing medium and silver halide grains containing at least 80 mole percent bromide, based on silver, wherein at least 50% of the projected area of said silver halide grains is accounted for by tabular grains, free of twin planes, having (100) parallel major faces, said method comprising (1) a step of nucleation whereby a fine grain emulsion is precipitated at a pAg in the range of from 4 to 6.5 and a pH in the range of from 2 to 5, while maintaining a stoichiometric excess of silver ion within the dispersing medium for a period of time up to 200 seconds of initiating step (1), (2) a ripening step at a pAg in the range of from 8 to 9.5 and a pH in the range of from 6 to 8, (3) a growth step, and (4) a chemical sensitization step.

2. The method of claim 1, wherein the stoichiometric excess of silver ion is maintained over a period of time in the range of from 0.5 to 200 seconds.

3. The method of claim 1, wherein the stoichiometric excess of silver ions is maintained over a period of from 10 to 100 seconds.

4. An emulsion prepared according to the method of claim 1, comprising a dispersing medium and silver halide grains comprising at least 80 mole percent bromide based on silver wherein at least 50 mole percent of the projected area of said silver halide grains is accounted for by tabular grains, free, of twin planes, having (100) parallel major faces and an aspect ratio in the range of at least 8, said emulsion being chemically sensitized and having a reciprocity failure of less than 35 sensitivity units between exposures of respectively $10^{-5}$ seconds and 100 seconds.

5. The emulsion of claim 4, wherein the tabular grains account for at least 70 percent of total grain projected area.

6. The emulsion of claim 4, wherein said tabular grains contain at least 90 mole percent bromide, based on total silver.

7. The emulsion of claim 4, which is sensitized by at least one chemical sensitizer chosen from the group consisting of sulfur, selenium and gold sensitizers.

* * * * *